US005906561A

United States Patent [19]

Lin

[11] Patent Number: 5,906,561

[45] Date of Patent: May 25, 1999

[54] STEPPING AND SWINGING EXERCISER

[76] Inventor: Ting Fung Lin, 12F-1, No. 83, Suei Yuan Road, Taipei, Taiwan

[21] Appl. No.: 09/066,083

[22] Filed: Apr. 24, 1998

[51] Int. Cl.[6] ..... A63B 22/00

[52] U.S. Cl. ..... 482/52

[58] Field of Search ..... 482/51, 52, 53, 482/57, 70, 79, 80, 148

[56] References Cited

U.S. PATENT DOCUMENTS

| | | | |
|---|---|---|---|
| 4,563,001 | 1/1986 | Terauds | 482/52 |
| 4,940,233 | 7/1990 | Bull et al. | 482/52 |
| 5,039,088 | 8/1991 | Shifferaw | 482/51 |
| 5,545,111 | 8/1996 | Wang et al. | 482/53 |
| 5,595,555 | 1/1997 | Chen | 482/51 |
| 5,645,512 | 7/1997 | Yu | 482/53 |
| 5,749,809 | 5/1998 | Lin | 482/52 |

*Primary Examiner*—Stephen R. Crow

[57] ABSTRACT

An exerciser includes a post having a lower portion rotatable secured to a base, and a bevel gear secured to the post and rotated in concert with the post. Another bevel gear is rotatably supported on the base at a pivot shaft and engaged with the bevel gear of the post. A pair of foot supports are supported on the base and coupled to the bevel gears for rotating the post via the bevel gears. A beam is secured to the pivot shaft and coupled to the foot supports. Another beam is rotatably secured on the base for supporting the rear ends of the foot supports in place.

2 Claims, 3 Drawing Sheets

STEPPING AND SWINGING EXERCISER

This application is related to patent application Ser. No. 09/096,862, filed Jun. 12, 1998, and Ser. No. 09/097,020, filed Jun. 12, 1998.

BACKGROUND OF THE INVENTION

1. Field of the Invention

The present invention relates to an exerciser, and more particularly to a stepping and swinging exerciser.

2. Description of the Prior Art

Two typical stepping exercisers are disclosed in U.S. Pat. Nos. 5,545,111 to Wang et al. and 5,645,512 to Yu and comprise a complicated structure for coupling the handle to the foot supports and for allowing the handle to be rotated by the foot supports. However, the structures are complicated such that the manufacturing costs are greatly increased.

The present invention has arisen to mitigate and/or obviate the afore-described disadvantages of the conventional stepping exercisers.

SUMMARY OF THE INVENTION

The primary objective of the present invention is to provide a stepping and swinging exerciser which includes a greatly simplified structure for allowing the user to conduct both stepping and swinging exercises and for decreasing the manufacturing cost of the exerciser.

In accordance with one aspect of the invention, there is provided an exerciser comprising a base, a post including a lower portion rotatably secured to the base, a first bevel gear secured to the post and rotated in concert with the post, a second bevel gear rotatably supported on the base at a pivot shaft and engaged with the first bevel gear for allowing the second bevel gear to rotate the post via the first bevel gear, a pair of foot supports supported on the base, and means for coupling the foot supports to the second bevel gear and to actuate the second bevel gear to rotate the post via the first bevel gear.

The coupling means includes a beam secured to the pivot shaft and rotated in concert with the second bevel gear, the foot supports each includes a first end pivotally coupled to the beam at a pivot pin. The base includes a second beam pivotally supported on the base at a pivot axle, the foot supports each includes a second end pivotally secured to the second beam for supporting the second ends of the foot supports in place.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figures 1, 2:
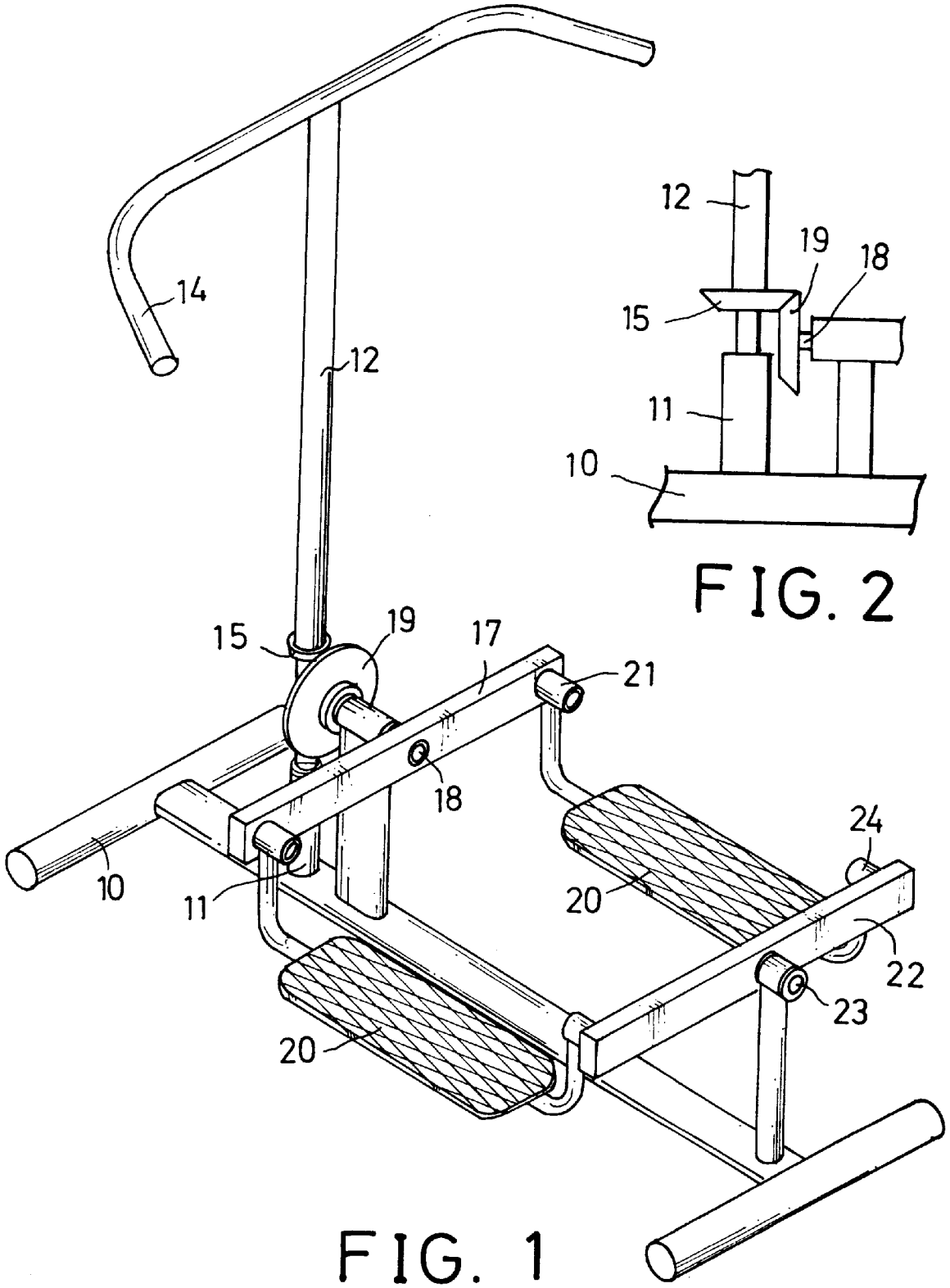
FIG. 1 is a perspective view of an exerciser in accordance with the present invention.
FIG. 2 is a partial plan view of the exerciser.
Figure 3:
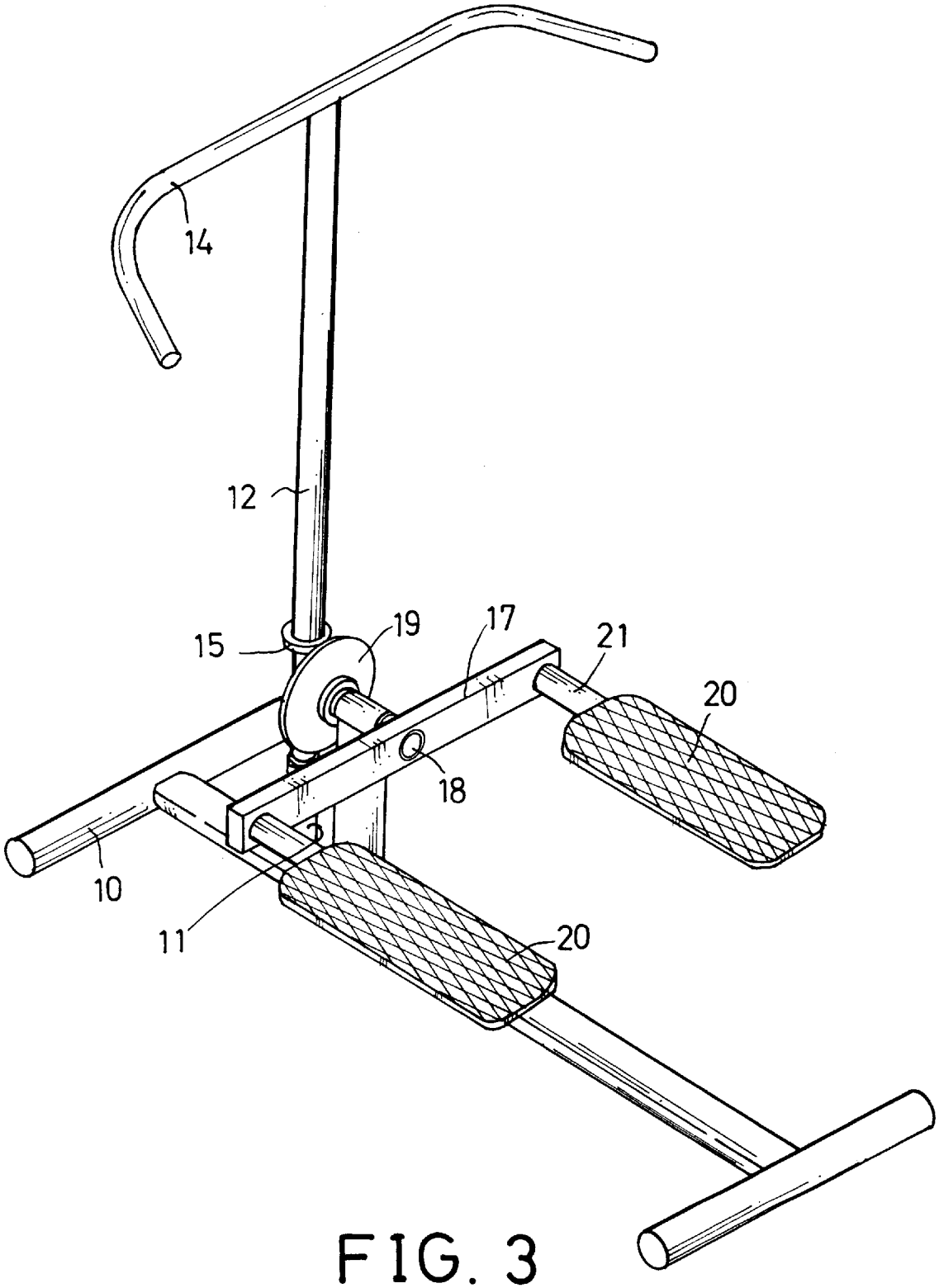
FIG. 3 is a perspective view illustrating another application of the exerciser.

Referring to the drawings, and initially to FIGS. 2 and 3, a stepping and swinging exerciser in accordance with the present invention comprises a base 10 including a hub 11 and a post 12 having a lower portion rotatably secured in the hub 11 and having a handle 14 provided on top thereof. The post 12 may also be rotatably secured to the base 10 without the hub 11. A bevel gear 15 is secured on the lower portion of the post 12. A beam 17 is rotatably supported on the base 10 at a pivot shaft 18 and another bevel gear 19 is secured to the pivot shaft 18 and rotated in concert with the beam 17 and engaged with the bevel gear 15. A pair of foot supports 20 are pivotally secured to the two ends of the beam 17 at a pair of pivot pins 21 for allowing the foot supports 20 to rotate the beam 17 about the pivot shaft 18 and for rotating the post 12 and the handle 14 via the bevel gears 15, 19.

For supporting the rear portions of the foot supports 20 in place, as shown in FIG. 1, a further beam 22 is pivotally supported on the rear portion of the base 10 at a pivot axle 23 and pivotally coupled to the rear portions of the foot supports 20 at a pair of pivot pins 24, such that the rear portions of the foot supports 20 may be stably supported in place.

In operation, the beam 17 may be rotated about the pivot shaft 18 by the foot supports 20 in order to rotate the post 12 and the handle 14 via the bevel gears 15, 19, such that the user may conduct swinging exercise in addition to the stepping exercise.

Figures 4, 5:
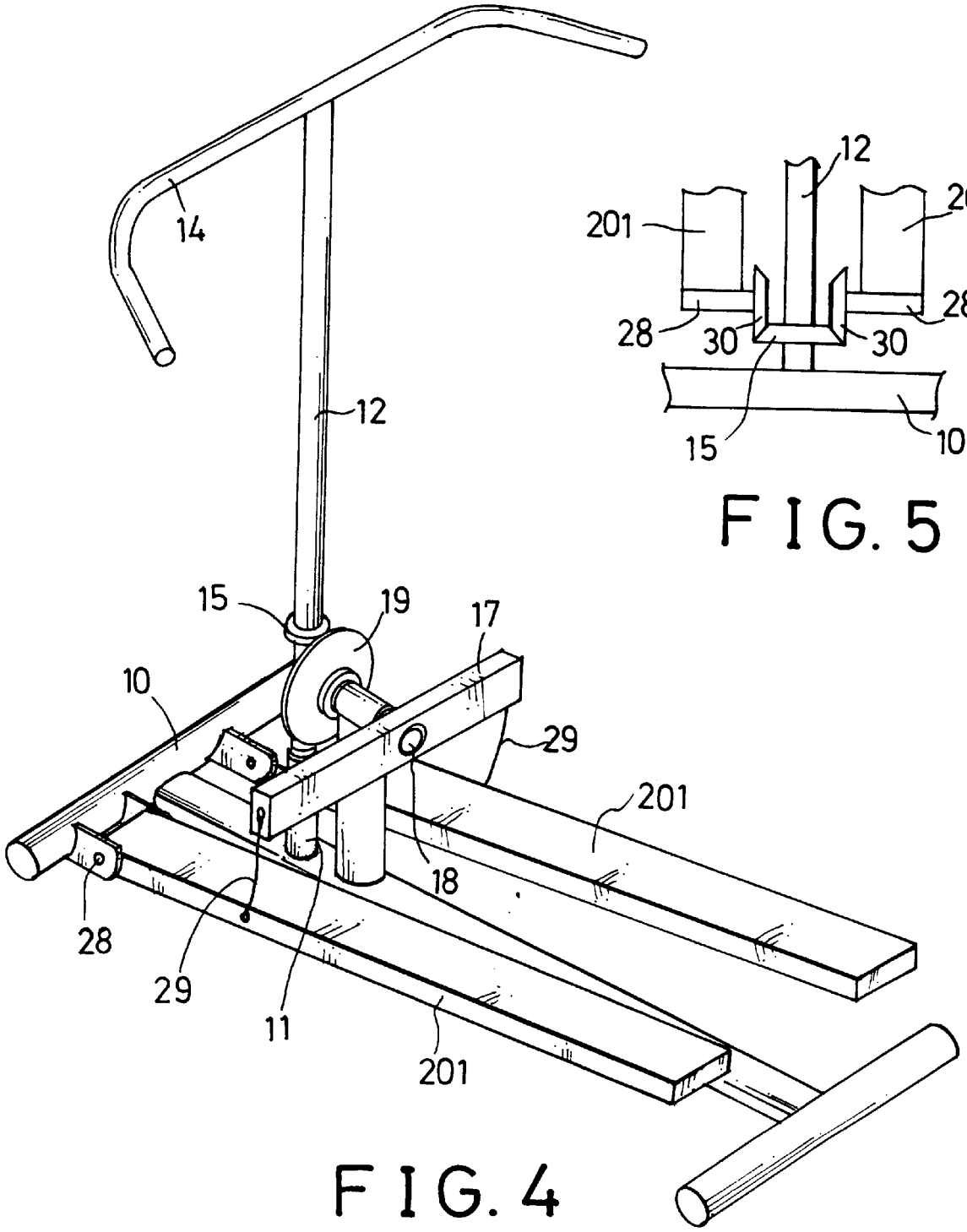
FIG. 4 is a perspective view illustrating a further application of the exerciser.
FIG. 5 is a partial plan view illustrating a still further application of the exerciser.

Referring next to FIG. 4, the foot supports 201 may include a front portion pivotally coupled to the base 10 at a pivot spindle 28 and coupled to the ends of the beam 17 by cables 29 or the like, such that the beam 17 may also be rotated about the pivot shaft 18 by the foot supports 201 and such that the post 12 and the handle 14 may also be rotated by the foot supports 201 via the bevel gears 15, 19. Alternatively, the foot supports 201 may engaged with the upper surfaces of the two ends of the beam 17 which includes two bearing supports, such as ball bearings, disposed on the ends for rotatably engaging with and for supporting the foot supports 201 in place. The Up and down movements of the foot supports 201 may also rotate the beam 17 and the bevel gears 15, 19 in order to rotate the post 12 and the handle 14.

Referring next to FIG. 5, two bevel gears 30 may be secured to the pivot spindles 28 of the foot supports 201 and may be engaged with the bevel gear 15 of the post 12 such that the post 12 may also be rotated by the foot supports 201.

Accordingly, the exerciser in accordance with the present invention includes a greatly simplified structure for allowing the user to conduct both stepping and swinging exercises and for decreasing the manufacturing cost of the exerciser.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base, a post including a lower portion rotatably secured to said base, a first bevel gear secured to said post and rotated in concert with said post, a second bevel gear rotatably supported on said base at a pivot shaft and engaged with said first bevel gear for allowing said second bevel gear to rotate said post via said first bevel gear, a beam secured to said pivot shaft and rotated in concert with said second bevel gear, and a pair of foot supports each including a first end pivotally coupled to said beam at a pivot pin, for allowing said foot supports to actuate said second bevel gear to rotate said post via said first bevel gear.

2. The exerciser according to claim 1, wherein said base includes a second beam pivotally supported above said base at a pivot axle, said foot supports each includes a second end pivotally secured to said second beam for supporting said second ends of said foot supports in place.

* * * * *